US006071085A

United States Patent [19]

Bernhardt

[11] Patent Number: 6,071,085

[45] Date of Patent: Jun. 6, 2000

[54] GAS BALLAST SYSTEM FOR A MULTI-STAGE POSITIVE DISPLACEMENT PUMP

[75] Inventor: Karl-Heinz Bernhardt, Braunfels, Germany

[73] Assignee: Pfeiffer Vacuum GmbH, Asslar, Germany

[21] Appl. No.: 09/351,735

[22] Filed: Jul. 12, 1999

[30] Foreign Application Priority Data

Jul. 11, 1998 [DE] Germany ..... 198 31 123

[51] Int. Cl.[7] ..... F04B 25/00

[52] U.S. Cl. ..... 417/251; 417/307; 417/252; 417/304; 417/441

[58] Field of Search ..... 415/251, 307, 415/252, 304, 441

[56] References Cited

U.S. PATENT DOCUMENTS

| | | | |
|---|---|---|---|
| 272,730 | 2/1883 | Mather | 417/251 |
| 688,520 | 12/1901 | Hill | 417/251 |
| 1,724,934 | 8/1929 | Hoppler | 417/251 |
| 2,205,793 | 6/1940 | Hunt | 417/251 |
| 2,812,771 | 11/1957 | McFarland et al. | 417/251 |
| 3,835,874 | 9/1974 | Dellasala | 137/15 |
| 4,784,579 | 11/1988 | Gazzera | 417/246 |
| 5,547,347 | 8/1996 | Sethna et al. | 417/250 |
| 5,820,354 | 10/1998 | Wild et al. | 417/244 |

*Primary Examiner*—Charles G. Freay
*Assistant Examiner*—Robert Z. Evora
*Attorney, Agent, or Firm*—Brown & Wood, LLP

[57] ABSTRACT

A gas ballast system for a multi-stage positive displacement pump in which a first stage includes at least one positive displacement pump stage, is equipped with an inlet valve and an outlet valve, and is connected with the following stage by an intermediate vacuum chamber, with the gas ballast system including a first conduit for supplying gas into the intermediate vacuum chamber, and a second conduit for supplying gas from the intermediate vacuum chamber into a pump chamber of the first stage or to a suction region of the first stage.

4 Claims, 1 Drawing Sheet

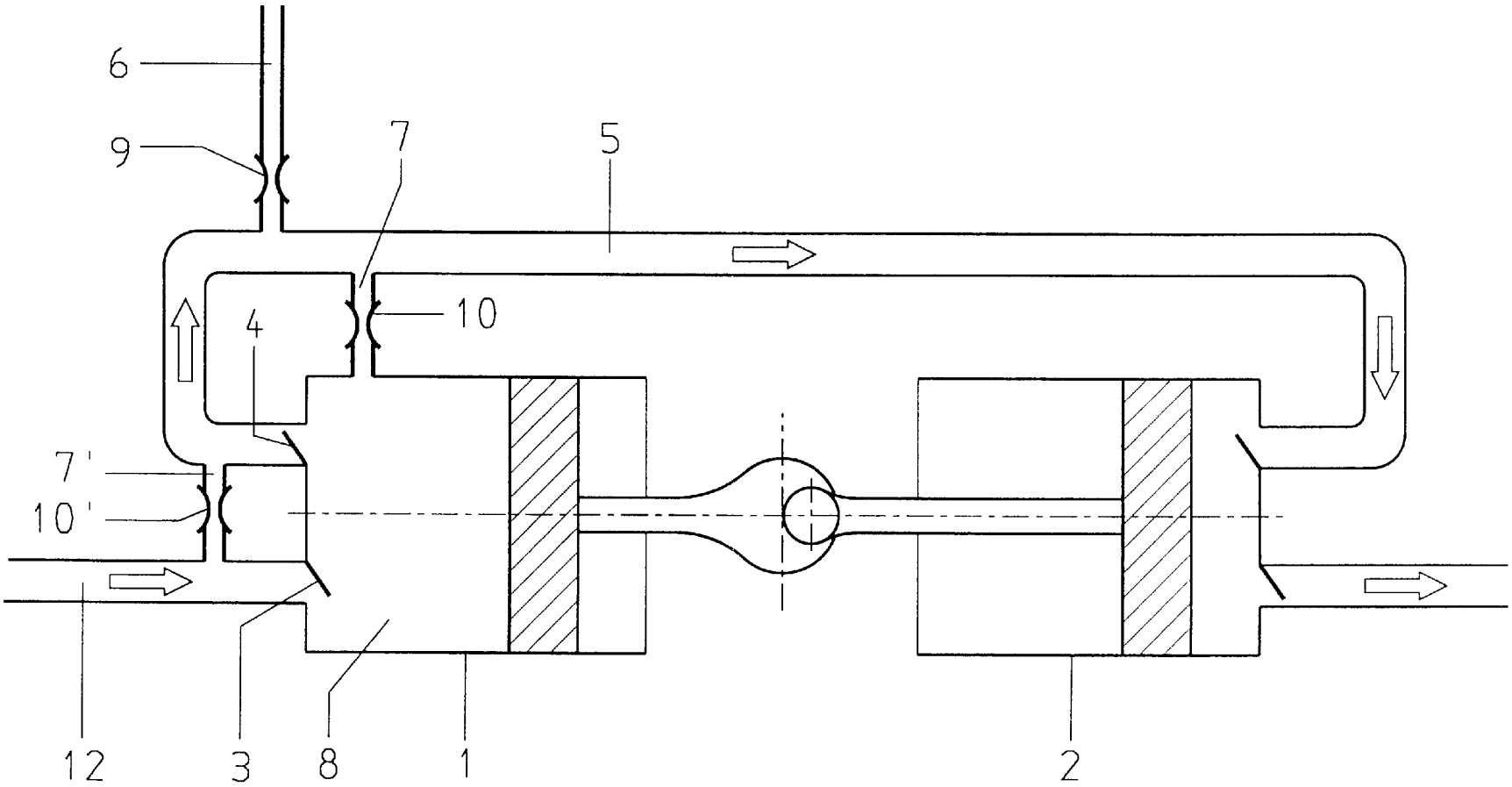
2
5
10
1
7
8
4
3
6
9
7'
10'
12

GAS BALLAST SYSTEM FOR A MULTI-STAGE POSITIVE DISPLACEMENT PUMP

BACKGROUND OF THE INVENTION

1. Field of the Invention

The present invention relates to a gas ballast system for a multi-stage positive displacement pump a first stage of which includes an inlet valve and an outlet valve and is connected with following stages via an intermediate vacuum chamber.

2. Description of the Prior Art

At present, multi-stage positive displacement pumps are increasingly used as forevacuum pumps for high vacuum pumps such as, e.g., turbomolecular pumps. In order for a high vacuum pump to reach its full capacity, the associated forevacumm pump should attain pressure of about 1–5 mbar. As a rule, vapor, e.g., water vapor is admixed to the pumped-out gas. During the compression stage, the vapor can condense in the forevacuum pump and, thus, is not conveyed further. To prevent the condensation of the vapor in the fore-vacuum pumps, formed, e.g., as rotary vane pumps, gas ballast systems are used. To this end, the gas from the atmosphere is admitted into the pump chamber. Specific design means in the rotary vane pumps prevents the admitted gas from reaching the suction chamber so that the admitted gas has little influence on the achievable end pressure. In this way, the condensing of vapor in the rotary vane pumps is prevented. When two-stage rotary vane pumps are used, the gas ballast is admitted only into the second stage. With the two-stage rotary vane pumps, the vapor can condense in the first stage. However, because oil is conveyed into the following stage with each revolution, condensate will also be conveyed into the second stage, together with the oil, where it is again evaporated and is expelled, together with the gas ballast air.

However, because in the rotary vane pumps, the pump chambers are sealed with oil, in many cases, they cannot be used as forevacuum pumps for turbomolecular pumps. By further development of the turbomolecular pumps, which have a last stage in a form of, e.g., a molecular pump such as a Holweck pump, the operational region of such pump combination has been expanded toward higher pressures. Thereby, it became possible to reduce the costs of obtaining of a forevacuum with respect to the pump size and the end pressure. In particular, it became possible to substitute dry pumps, e.g., diaphragm pumps, for oil sealed vacuum pumps. This is particular important in applications in which oil-free vacuum is required. The use of a diaphragm pump as a forevacuum pump particularly makes sense when the turbomolecular pump is formed as a magnetically supported turbomolecular pump. In this case, in none of the phases of a pumping process, the pumped out gas comes into contact with a lubricant, and no volatile components, which are primarily contained in a lubricant, are diffused toward the high vacuum side and pollute it.

Because the wall of a vacuum chamber is always loaded with water, it reaches, via the turbomolecular pump, the suction region and, thus, penetrates into the pump chamber of the diaphragm pump. In particular during heating of the vacuum chamber, an increased amount of water is released. The released water must be pumped into the atmosphere with the forevacuum pump. In case the water vapor pressure during the compression in the first stage of the forevacuum pump is lower, because of the temperature relationships, than the pressure in the intermediate vacuum chamber of the forevacuum pump, the water vapor becomes condensed in front of the outlet valve and evaporates again upon the increase of the pump chamber. As a result, the pressure is inadequate for opening of the outlet valve, and the forevacuum pressure increases to an inadmissible high value. Often, the maximum permissible forevacuum pressure of a turbomolecular pump is exceeded, and its end rotational speed cannot be achieved. As a result, the vacuum in the vacuum chamber remains below the desired value.

The use of gas ballast system, as in the rotary vane pumps, here does not make sense. Diaphragm pumps and piston pumps or comparable apparatuses do not have the particularities of the rotary vane pumps. Specifically, they do not include a gas ballast valve which blocks the admitted gas from reaching the suction region. The gas ballast must directly be admitted into the pump chamber of the first stage which can result in impermissible increase of the end pressure. It is possible to reduce the admittable amount of gas by providing a restriction having a very narrow cross-section. However, in this case, a danger of clogging arises, and the operational reliability is reduced. By using a controlled value, it is possible to prevent the increase of pressure in the pump chamber as a result of admission of the gas ballast. However, this solution noticeably increases the costs of the entire system.

Accordingly, an object of the present invention is to provide a gas ballast system for multi-stage vacuum pumps, e.g., diaphragm pumps or piston pumps.

Another object of the present invention is to provide a gas ballast system for multi-stage vacuum pump with which an adequate amount of gas can be delivered into the pump chamber of the first stage, without adversely affecting the end vacuum and without a necessity to use a restriction with a narrow cross-section.

A further object of the present invention is to provide a gas ballast system for multi-stage vacuum pumps which would be inexpensive and without the use of additional expensive components.

SUMMARY OF THE INVENTION

These and other object of the present invention, which will become apparent hereinafter, are achieved by providing a gas ballast system including a first conduit for admitting gas into the intermediate vacuum chamber, and a second conduit for admitting gas from the intermediate vacuum chamber into the pump chamber of the first stage.

The intermediate vacuum chamber instead of being connected with the pump chamber of the first stage, can be connected with the suction region of the first stage so that the gas from the intermediate vacuum chamber in conveyed into the suction region. At least one of the conduits, which convey the gas to the intermediate vacuum chamber and from the intermediate vacuum chamber to the pump chamber of the first stage or from the intermediate vacuum chamber to the suction region of the first stage, respectively, can include a restriction.

During the admittance of the gas into the pump chamber, the vacuum chamber remains sealed upon turning off the forepump. Moreover, the sealing of the vacuum chamber even improves due to the increase of pressure in the pump chamber. This is particular important at an intermittent operation. A long-lasting conveying of the gas through the outlet valve prevents sticking of the valve.

The present invention provides an effective gas ballast system for the above-described forevacuum pumps, in which system gas is admitted into the intermediate vacuum chamber and is metered through a restriction so that it does not noticeably influences pump characteristics and the end pressure.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments when read with reference to the accompanying drawings.

BRIEF DESCRIPTION OF THE DRAWINGS

Single FIGURE shows a schematic view of a positive displacement pump according to the present invention formed, by way of example, as a piston pump.

DETAILED DESCRIPTION OF THE PREFERRED EMBODIMENT

A positive displacement pump according to the present invention, which is formed in the embodiment discussed below as a piston pump, has two stages 1 and 2. The first stage 1 has an inlet valve 3 and an outlet valve 4. The two stages 1 and 2 are connected with each other by an intermediate vacuum chamber 5. For feeding gas into the intermediate vacuum chamber 5, there is provided a first conduit 6 having a restriction 9. For connecting the intermediate vacuum chamber 5 with a pump chamber 8 of the first stage 1, there is provided a second conduit 7 having a restriction 10. The intermediate vacuum chamber 5, instead of being connected with the gas supply via the conduit 6 and with the pump chamber 8 of the stage 1 via the conduit 7, can be connected to a suction region 12 via a conduit 7' having a restriction 10'.

Though the present invention has been shown and described with reference to a preferred embodiment, such is merely illustrative of the present invention and is not to be construed as to be limited to the disclosed embodiment and/or details thereof, and the present invention includes all modifications, variations and/or alternate embodiments within the spirit and scope of the present invention as defined by the appended claims.

What is claimed is:

1. A gas ballast system for a multi-stage positive displacement pump in which a first stage includes at least one positive displacement pump stage, which is equipped with an inlet valve and an outlet valve, and is connected with a second stage by an intermediate vacuum chamber, the gas ballast system comprising:

first conduit means for supplying gas into the intermediate vacuum chamber from outside; and second conduit means for supplying gas from the intermediate vacuum chamber into a pump chamber of the first stage.

2. A gas ballast system as set forth in claim 1, wherein at least one of the first and second conduit means has a restriction.

3. A gas ballast system for a multi-stage positive displacement pump in which a first stage includes at least one positive displacement pump stage, is equipped with an inlet valve and an outlet valve, and is connected with a second stage by an intermediate vacuum chamber, the gas ballast system comprising:

first conduit means for supplying gas into the intermediate vacuum chamber from outside; and second conduit means for supplying gas from the intermediate vacuum chamber to suction region of the first stage.

4. A gas ballast system as set forth in claim 3, wherein at least one of the first and second conduit means has a restriction.

* * * * *